US011878339B2

(12) United States Patent
Wagstaff

(10) Patent No.: US 11,878,339 B2
(45) Date of Patent: Jan. 23, 2024

(54) ULTRASONIC TREATMENT FOR MICROSTRUCTURE REFINEMENT OF CONTINUOUSLY CAST PRODUCTS

(71) Applicant: Novelis Inc., Atlanta, GA (US)

(72) Inventor: Samuel Robert Wagstaff, Marietta, GA (US)

(73) Assignee: NOVELIS INC., Atlanta, GA (US)

( * ) Notice: Subject to any disclaimer, the term of this patent is extended or adjusted under 35 U.S.C. 154(b) by 0 days.

(21) Appl. No.: 17/759,925

(22) PCT Filed: Jan. 14, 2021

(86) PCT No.: PCT/US2021/013370

§ 371 (c)(1),
(2) Date: Aug. 2, 2022

(87) PCT Pub. No.: WO2021/162820

PCT Pub. Date: Aug. 19, 2021

(65) Prior Publication Data

US 2023/0064883 A1 Mar. 2, 2023

Related U.S. Application Data

(60) Provisional application No. 62/977,067, filed on Feb. 14, 2020.

(51) Int. Cl.
*B22D 11/115* (2006.01)
*B22D 11/00* (2006.01)
(Continued)

(52) U.S. Cl.
CPC ..... *B22D 11/115* (2013.01); *B22D 11/003* (2013.01); *B22D 11/122* (2013.01); *B22D 11/1287* (2013.01); *B22D 11/0605* (2013.01)

(58) Field of Classification Search
CPC ... B22D 11/00; B22D 11/003; B22D 11/0605; B22D 11/114; B22D 11/115;
(Continued)

(56) References Cited

U.S. PATENT DOCUMENTS 4,460,033 A * 7/1984 Tsubakihara et al. ..... B22D 11/225 164/455

FOREIGN PATENT DOCUMENTS

JP S55 40056 A 3/1980
JP S56 105855 A 8/1981
(Continued)

OTHER PUBLICATIONS

International Application No. PCT/US2021/013370 , "International Search Report and Written Opinion", dated Mar. 30, 2021, 10 pages.
(Continued)

*Primary Examiner* — Kevin P Kerns
(74) *Attorney, Agent, or Firm* — Kilpatrick Townsend & Stockton LLP

(57) ABSTRACT

Described herein are techniques for improving the grain structure of a metal product by applying ultrasonic energy to a continuously cast metal product at a position downstream from the casting region and allowing the ultrasonic energy to propagate through the metal product to the solidification region. At the solidification region, the ultrasonic energy can interact with the growing metal grains, such as to deagglomerate and disperse nucleating particles and to disrupt and fragment dendrites as they grow, which can promote additional nucleation and result in smaller grain sizes.

19 Claims, 4 Drawing Sheets

(51) Int. Cl.
*B22D 11/12* (2006.01)
*B22D 11/128* (2006.01)
*B22D 11/06* (2006.01)

(58) Field of Classification Search
CPC ..... B22D 11/12; B22D 11/122; B22D 11/128; B22D 11/1287
USPC ..... 164/48, 498, 501, 502, 250.1, 505, 511
See application file for complete search history.

(56) References Cited

FOREIGN PATENT DOCUMENTS

| | | | |
|---|---|---|---|
| JP | S56 114560 | A | 9/1981 |
| JP | S61 253150 | A | 11/1986 |
| JP | 1190615 | A | 4/1999 |
| JP | 2002018559 | A | 1/2002 |
| JP | 2002331341 | A | 11/2002 |
| JP | 2004098111 | A | 4/2004 |
| JP | 2007118041 | A | 5/2007 |

OTHER PUBLICATIONS

PCT/US2021/013370 , "International Preliminary Report on Patentability", dated Aug. 25, 2022, 7 pages.
CA3, 165, 117 , "Office Action", dated May 23, 2023, 3 pages.
IN202217038752 , "First Examination Report", dated Nov. 30, 2022, 6 pages.
"Ultrasonics", Available Online at: https://www.britannica.com/science/ultrasonics, Retrieve from Internet on Aug. 23, 2023, 10 pages.
"Ultrasound", Available Online at: https://en.wikipedia.org/wiki/Ultrasound, Aug. 16, 2023, 16 pages.
EP21704993.1 , "Office Action", dated Jul. 19, 2023, 5 pages.
JP2022-548725 , "Office Action", dated Sep. 26, 2023, 8 pages.
KR10-2022-7022224 , "Office Action", dated Aug. 23, 2023, 4 pages.

* cited by examiner

ULTRASONIC TREATMENT FOR MICROSTRUCTURE REFINEMENT OF CONTINUOUSLY CAST PRODUCTS

CROSS-REFERENCE TO RELATED APPLICATIONS

This application claims the benefit of and priority to U.S. Provisional Application No. 62/977,067, filed on Feb. 14, 2020, which is hereby incorporated by reference in its entirety.

FIELD

The present disclosure relates to metallurgy generally and more specifically to techniques for controlling microstructure of continuously cast products using ultrasonic treatment.

BACKGROUND

Ultrasonic energy can be applied to metal products to modify the structural and mechanical characteristics. For example, ultrasonic impact treatment can be used to strengthen metal products, particularly those which may have their strength reduced by exposure to elevated temperatures, such as at or adjacent to weld joints. By subjecting the metal product or joint to ultrasonic energy, such as by using a mechanical impact treatment at ultrasonic frequencies, residual stress within the material can be manipulated to enhance the mechanical properties, strength, fatigue, and corrosion resistance. Ultrasonic treatments can also be used when casting metal products to refine the microstructure during solidification.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

By introducing ultrasonic cavitation into a solidifying melt, grain refinement can occur via the activation of substrates by wetting, deagglomeration and dispersion of nucleating particles, and dendrite fragmentation. For casting techniques featuring large diameter open top billets or ingots, like direct chill (DC) casting, ultrasonic energy can be applied by inserting an ultrasonic transducer or sonotrode directly within the molten metal.

Some disadvantages may occur by such a configuration, however. For example, the sonotrode or ultrasonic transducer must be made of a material that can sustain exposure to high temperatures and also of an inert material to limit destruction of the sonotrode or ultrasonic transducer and contamination of the molten metal. Example inert materials used may include niobium, tungsten, sialons, graphite, or the like. While these materials may be inert in some metals (e.g., steel), they are not necessarily inert in all molten metals. Further, these materials may still be subject to erosion while placed in the molten metal. For example, the inert materials may erode at a rate of 1-10 μm/hour. Such erosion rates may make efficient coupling of the ultrasonic energy to the desired location within the cast material difficult. For example, the sonotrode or ultrasonic transducer may need to be located at a position and use an ultrasonic frequency that positions a maxima or node of the ultrasonic wave at the solidification region within the cast metal and account for thermal expansion of the sonotrode or ultrasonic transducer material. Further, since the inert material erodes over time, the optimal frequency or position may change over time. Also, replacement of the sonotrode or ultrasonic transducer may be needed due to the erosion, and this is generally accompanied by significant operational costs and complexities, including downtime and costs associated with removal and replacement.

For application of ultrasonic energy to continuous casters, like twin roll casters, block casters, and belt casters, access to the molten metal may be limited, due to the narrow gauge of launders, tundishes, and nosetips used to deliver the molten metal into the continuous casting region. Thus, placing a sonotrode or ultrasonic transducer directly into the molten metal in a continuous casting system may be difficult or impractical. Such a configuration also does not overcome the disadvantages described above relating to materials and erosion.

It may be useful to place a sonotrode or ultrasonic transducer in contact with a launder, tundish, or nosetip but not directly within the molten metal, though coupling of ultrasonic energy from the launder, tundish, or nosetip through the molten metal to the solidification region may be inefficient. Further, access for such a configuration may still be limited, depending on the process or equipment used.

In continuous casting systems, the cast slab may be fed to a pair of pinch rolls downstream of the caster, such as to provide negative tension to address improper feeding or tearing. At the pinch rolls, pressure may be applied directly to the cast slab, providing an opportunity to couple ultrasonic energy into the cast slab. Due to the pressure applied by the pinch rolls, transmission of the ultrasonic energy from the pinch rolls and into the cast slab can be very efficient, allowing ultrasonic energy to be transmitted to the solidification region, where the ultrasonic energy can contribute to grain refinement.

Another approach to providing ultrasonic energy to the solidification region may be to generate forces directly within the cast metal or molten metal at the solidification region, such as by generation of magnetohydrodynamic forces that arise by the interaction of the metal with externally applied magnetic and electric fields. In one example, magnetohydrodynamic forces may be generated using a static magnetic field source (e.g., a permanent or electromagnet) and a variable electric field source (e.g., an alternating current (AC) voltage source). In another example, magnetohydrodynamic forces may be generated using a variable magnetic field source (e.g., an electromagnet driven by a variable current) and a static electric field source (e.g., a direct current (DC) voltage source).

Other objects and advantages will be apparent from the following detailed description of non-limiting examples.

BRIEF DESCRIPTION OF THE FIGURES

The specification references the following appended figures, in which use of like reference numerals in different figures is intended to illustrate like or analogous components.

DETAILED DESCRIPTION

Described herein are techniques for improving the grain structure of a metal product by applying ultrasonic energy to a continuously cast metal product at a position just downstream from the casting region and allowing the ultrasonic energy to propagate through the metal slab to the solidification region. At the solidification region, the ultrasonic energy can interact with the growing metal grains, such as to deagglomerate and disperse nucleating particles and to disrupt and fragment dendrites as they grow, which can promote additional nucleation and result in smaller grain sizes.

DEFINITIONS AND DESCRIPTIONS

As used herein, the terms "invention," "the invention," "this invention" and "the present invention" are intended to refer broadly to alt of the subject matter of this patent application and the claims below. Statements containing these terms should be understood not to limit the subject matter described herein or to limit the meaning or scope of the patent claims below.

In this description, reference may be made to alloys identified by AA numbers and other related designations, such as "series" or "7xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot." both published by The Aluminum Association.

As used herein, terms such as "cast metal product," "cast product," "cast alloy product," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

As used herein, the meaning of "a," "at r," and "the" includes singular and plural references unless the context clearly dictates otherwise.

Methods of Producing Metal Products

Figure 1:
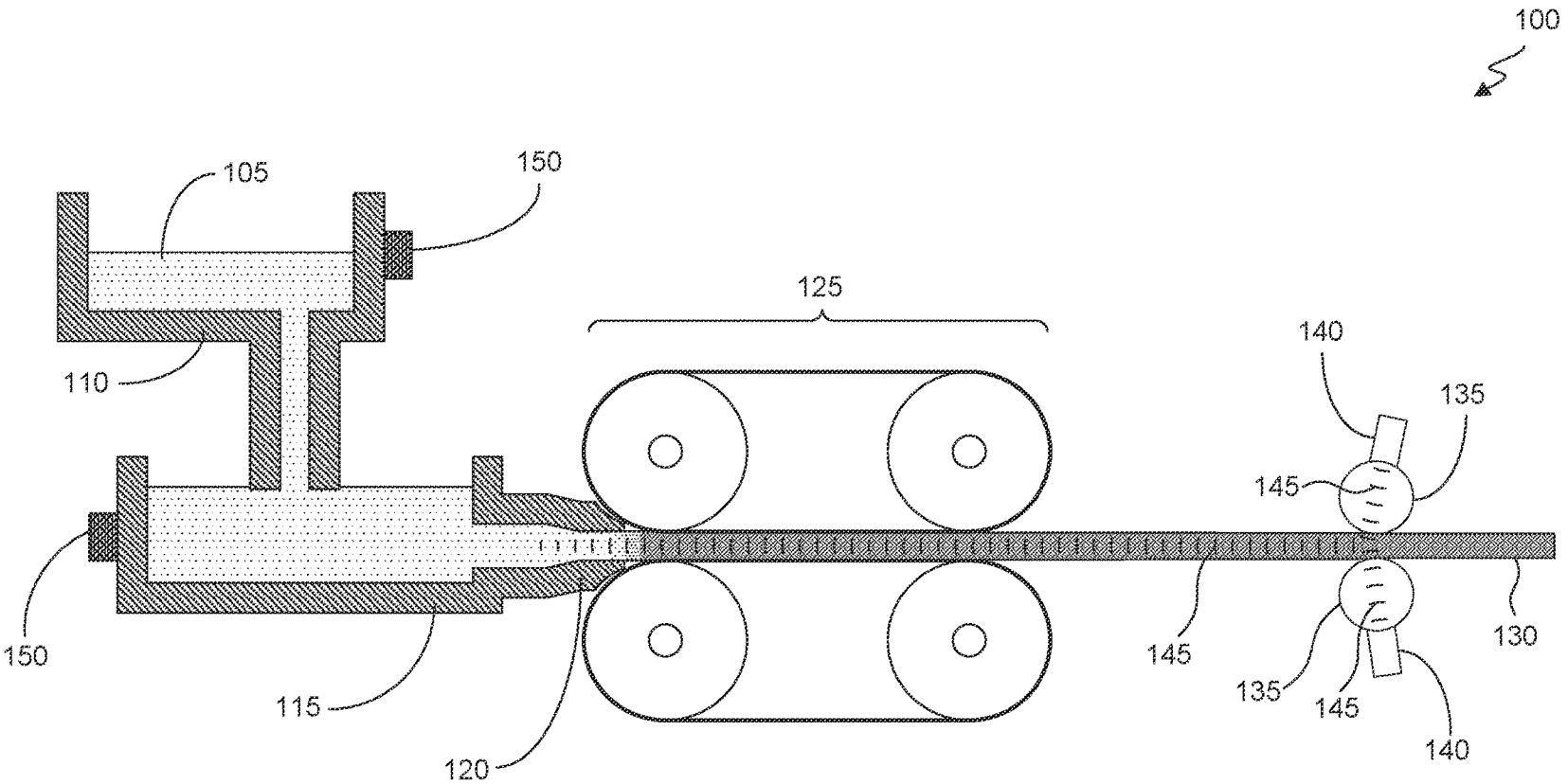
FIG. 1 is a schematic illustration of an example continuous casting process in which ultrasonic energy is applied to a cast metal slab.

FIG. 1 shows a schematic illustration of an example continuous casting system 100. Here molten metal 105 is transferred from a launder 110 to a tundish 115 and into a nosetip or nozzle 120 of a twin-belt caster 125, where the molten metal 105 solidifies and cools to form a cast slab 130. Downstream from twin-belt caster 125, pinch rolls 135 apply pressure to cast slab 130 and draw cast slab 130 away from twin-belt caster 125. Although FIG. 1 is described as producing a cast slab 130, other cast metal products can be prepared according to the disclosed techniques, such as cast metal rods, cast metal billets, cast metal sheets, cast metal plates, or the like. Continuous casting system 100 illustrated in FIG. 1 shows a twin-belt caster 125, but such a configuration is not limiting and other continuous casting systems, such as twin roll casters and block casters, may be used. Further, other configurations may be used that do not employ a tundish or launder. A vertical casting orientation may also be used.

Pinch rolls 135 are depicted in FIG. 1 as coupled to ultrasonic transducers 140, which generate ultrasonic waves 145. Ultrasonic waves 145 are transferred into cast slab 130 by pinch rolls 135. Ultrasonic transducers 140 may be arranged or configured with respect to pinch rolls 135 to couple ultrasonic waves 145 upstream within cast slab 130 towards nosetip or nozzle 120. For example, the orientation and/or position of ultrasonic transducers 140 may be optionally configured to couple ultrasonic waves 145 primarily in the upstream direction and to limit the amount of or magnitude of ultrasonic waves 145 that travel in the downstream direction within cast slab 130. Additionally or alternatively, a phase shift may exist between the ultrasonic transducers 140 to directionally guide ultrasonic waves 145 toward twin-belt caster 125. In this way, energy from ultrasonic waves 145 can couple to the solidification region within twin-belt caster 125 adjacent to nosetip or nozzle 120 and achieve refinement of the grain of cast slab 130.

The configuration of the twin-belt caster 125 in supporting anchor cooling cast slab 130 may be such that the ultrasonic waves 145 do not efficiently couple from cast slab 130 into the belt of twin-belt caster 125. For example, cast slab 130 and twin-belt caster 125 may not be strongly mechanically coupled to allow for efficient transmission of ultrasonic energy.

Ultrasonic transducers 140 may generate ultrasonic waves 145 at a frequency of from about 10 kHz to 70 kHz or up to about 3 MHz, depending on the configuration and materials used, for example. Ultrasonic transducers 140 may have a controllable or variable frequency output to directionally affect the transmission of ultrasonic waves 145 and/or alter the location of minima and maxima of ultrasonic waves 145 within the solidification region so as to control the grain refinement that occurs.

Figure 2:
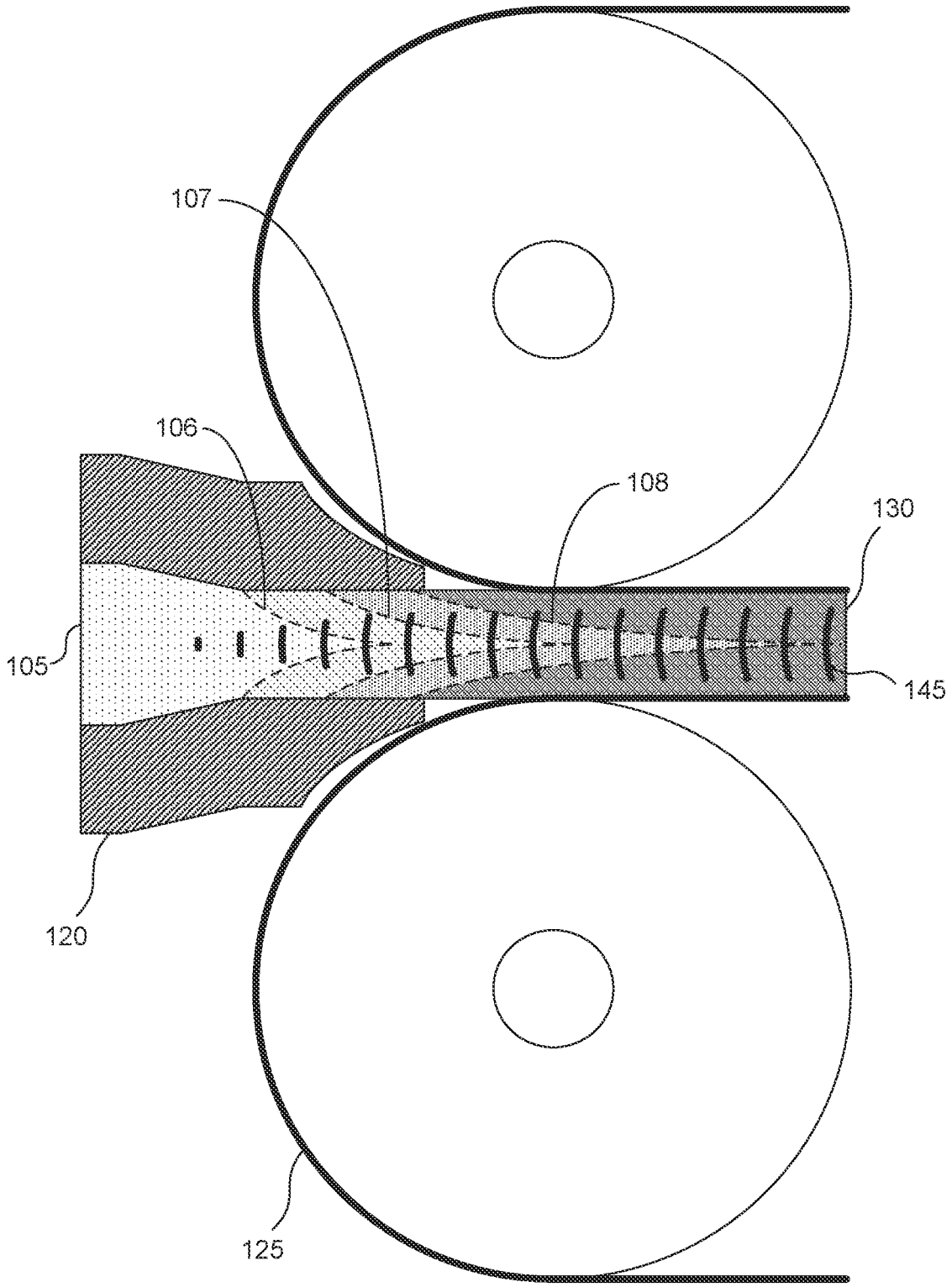
FIG. 2 is a schematic illustration showing an expanded view of the solidification region in a continuous casting process.

FIG. 2 provides an expanded view of continuous casting system 100 showing the solidification region. Within the solidification region, the molten metal 105 transitions through a partially solid region between the liquidus temperature and the solidus temperature and ultimately solidifies at the output of nosetip or nozzle 120 and within twin-belt caster 125. An example liquidus isotherm 106 is shown, which identifies the position at which the temperature of the metal reaches the liquidus temperature. An example coherency isotherm 107 is also shown, which identifies the position at which the temperature of the metal reaches the coherency temperature. An example solidus isotherm 108 is also shown, which identifies the position at which the temperature of the metal reaches the solidus temperature and beyond which the metal is completely solid. It will be appreciated that the liquidus isotherm 106, coherency isotherm 107, and solidus isotherm 108 shown in FIG. 2 are exemplary and useful for illustrating the structure of the solidification region. The actual position and shape of the isotherms may be different, depending on the configuration, geometry, materials, temperatures, cooling rates, or the like used by continuous casting system 100.

In between liquidus isotherm 106 and coherency isotherm 107, the temperature of the metal is between the liquidus temperature and the coherency temperature. Here, the metal includes molten metal and suspended solid metal grains that generally are not large enough to touch one another. As the temperature reduces towards the coherency temperature, the metal grains grow and form dendrites until the coherency isotherm is reached, at which point the metal grains are large enough such that contact with one another is unavoidable. In between coherency isotherm 107 and solidus isotherm 108, the temperature of the metal is between the coherency temperature and the solidus temperature and the metal includes molten metal between solid metal grains. As the temperature reduces towards the solidus temperature, the metal grains continue to grow until they completely incorporate all the molten metal by solidification.

Ultrasonic waves 145 are depicted in FIG. 2 and are shown being transmitted into the solidification region along the length of cast slab 130. Ultrasonic waves 145 may correspond to high frequency longitudinal pressure waves, for example, and may physically interact with the growing metal grains, such as by fragmenting dendrites, dispersing and deagglomerating small grains or nucleation sites, or the like, to refine and reduce the grain size. Since the cast slab 130 is solid at positions downstream of solidus isotherm 108, transmission of ultrasonic waves 145 through the cast metal slab 130 may be efficient. As ultrasonic waves 145 reach the solidification zone, their energy may begin to be absorbed and dispersed through molten metal 105.

Returning to FIG. 1, one or more acoustic receivers 150 may be positioned upstream from nosetip or nozzle 120. Acoustic receivers 150 may be used to detect residual ultrasonic energy that transmits through molten metal 105 to launder 110 or tundish 115, for example. The information detected by acoustic receivers 150 may be used for feedback control over ultrasonic transducers 140, such as to control the amplitude, frequency, phase shift, or the like of the ultrasonic waves 145 generated by ultrasonic transducers 140. Further feedback may be provided by examination of the grain structure of the cast slab 130, which can indicate whether ultrasonic transducers are operating to efficiently refine the grain structure of the cast slab 130.

Figure 3:
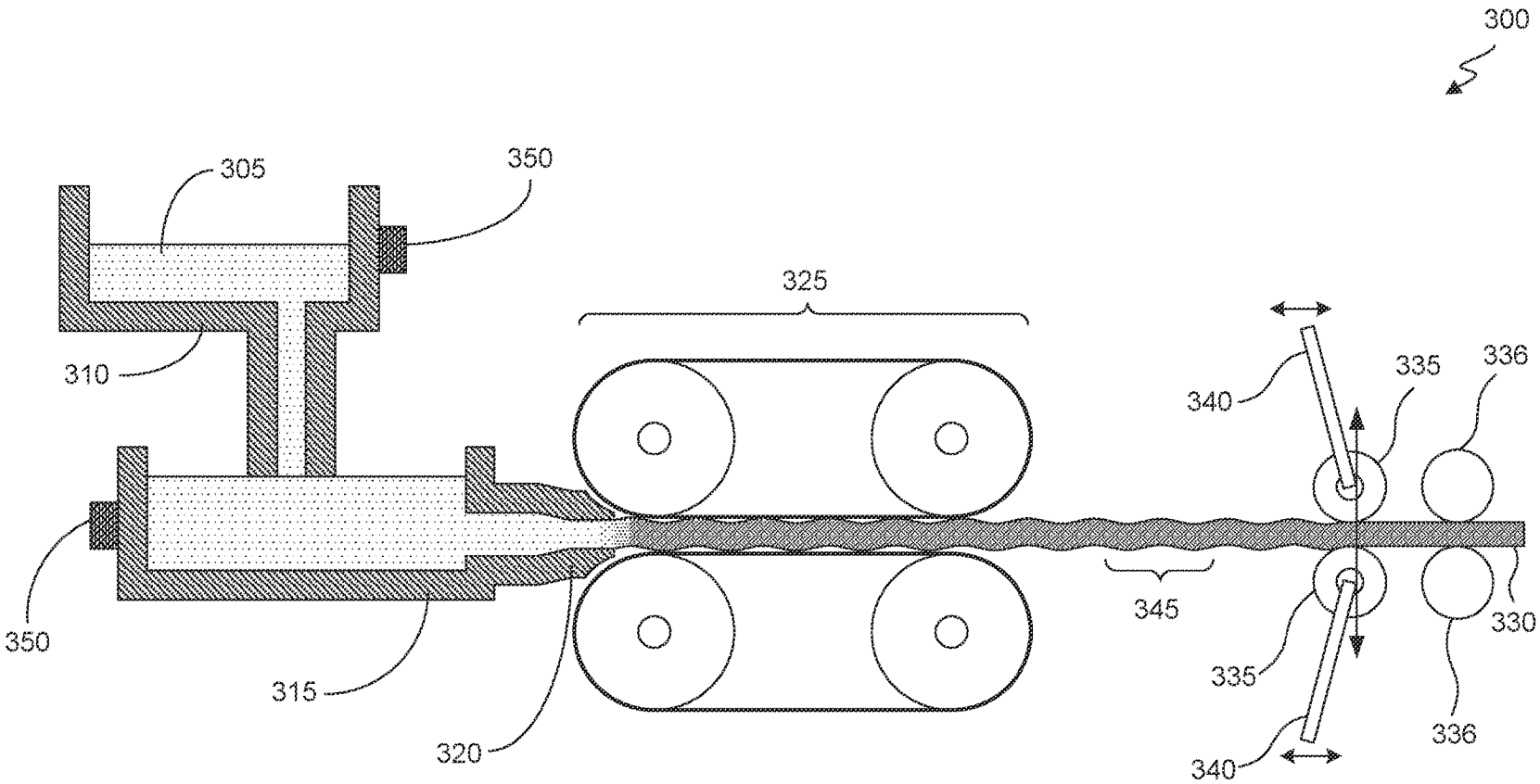
FIG. 3 is a schematic illustration of an example continuous casting process in which ultrasonic frequency mechanical vibrations are applied to a cast metal slab.

FIG. 3 shows a schematic illustration of another example continuous casting system 300. Here molten metal 305 is transferred from a launder 310 to a tundish 315 and into a nosetip or nozzle 320 of a twin-belt caster 325, where the molten metal 305 solidifies and cools to form a cast slab 330. Downstream from twin-belt caster 325, pinch rolls 335 apply pressure to cast slab 330 and draws cast slab 330 away from twin-belt caster 325. Although FIG. 3 is described as producing a cast slab 330, other cast metal products can be prepared according to the disclosed techniques, such as cast metal rods, cast metal billets, cast metal sheets, cast metal plates, or the like. Continuous casting system 300 illustrated in FIG. 3 shows a twin-belt caster 325, but such a configuration is not limiting and other continuous casting systems, such as twin roll casters and block casters, may be used. Further, other configurations may be used that do not employ a tundish or launder. A vertical casting orientation may also be used.

Pinch rolls 335 are depicted in FIG. 3 as coupled to supports 340, which are movable. Here, translation of the pinch rolls 335 in the vertical direction can allow for creation of vibrational movement of the cast slab 330. Although vertical translation is depicted in FIG. 3, lateral translation in/out of the view or plane shown in FIG. 3 is also or alternatively possible. The translation may be induced by mechanical or electromechanical actuators coupled to the pinch rolls 335 or supports 340. The translation may generate transverse waves 345 within cast slab 330. Transverse waves 345 depicted in FIG. 3 show an exaggerated amplitude and wavelength for illustration purposes and may not be visually perceptible, depending on the frequency and amplitude.

An example frequency of the transverse waves 345 may be from at a frequency of from about 10 kHz to about 100 kHz, such as from 10 kHz to 20 kHz, from 20 kHz to 30 kHz, from 30 kHz to 40 kHz, from 40 kHz to 50 kHz, from 50 kHz to 60 kHz, from 60 kHz to 70 kHz, from 70 kHz to 80 kHz, from 80 kHz to 90 kHz, or from 90 kHz to 100 kHz, depending on the configuration and materials used, for example. The actuation of motion of pinch rolls 335 may have a controllable or variable frequency and a controllable or variable amplitude to alter the locations of minima and maxima of transverse waves 345 within the solidification region so as to control the grain refinement that occurs. Pinch rolls 335 may also be translatable along the horizontal direction to control the locations of minima and maxima of transverse waves 345. Secondary pinch rolls 336 may be used to limit propagation of the transverse waves in a downstream direction.

The configuration of the twin-belt caster 325 in supporting and/or cooling cast slab 330 may be such that the transverse waves 345 do not efficiently couple from cast slab 330 into the belt of twin-belt caster 325. For example, cast slab 330 and twin-belt caster 325 may not be strongly mechanically coupled.

One or more high-frequency sensors 350 may be positioned upstream from nosetip or nozzle 320. High-frequency sensors 350 may be used to detect residual vibrational energy that transmits through molten metal 305 to launder 310 or tundish 315, for example. The information detected by high-frequency sensors 350 may be used for feedback control over the mechanical or electromechanical actuators adjusting the position of pinch rolls 335 generating transverse waves 345, such as to control the amplitude and frequency of the transverse waves 345. Further feedback may be provided by examination of the grain structure of the cast slab 330, which can indicate whether the vibrational energy is affecting the grain structure of the cast slab 330.

Figure 4:
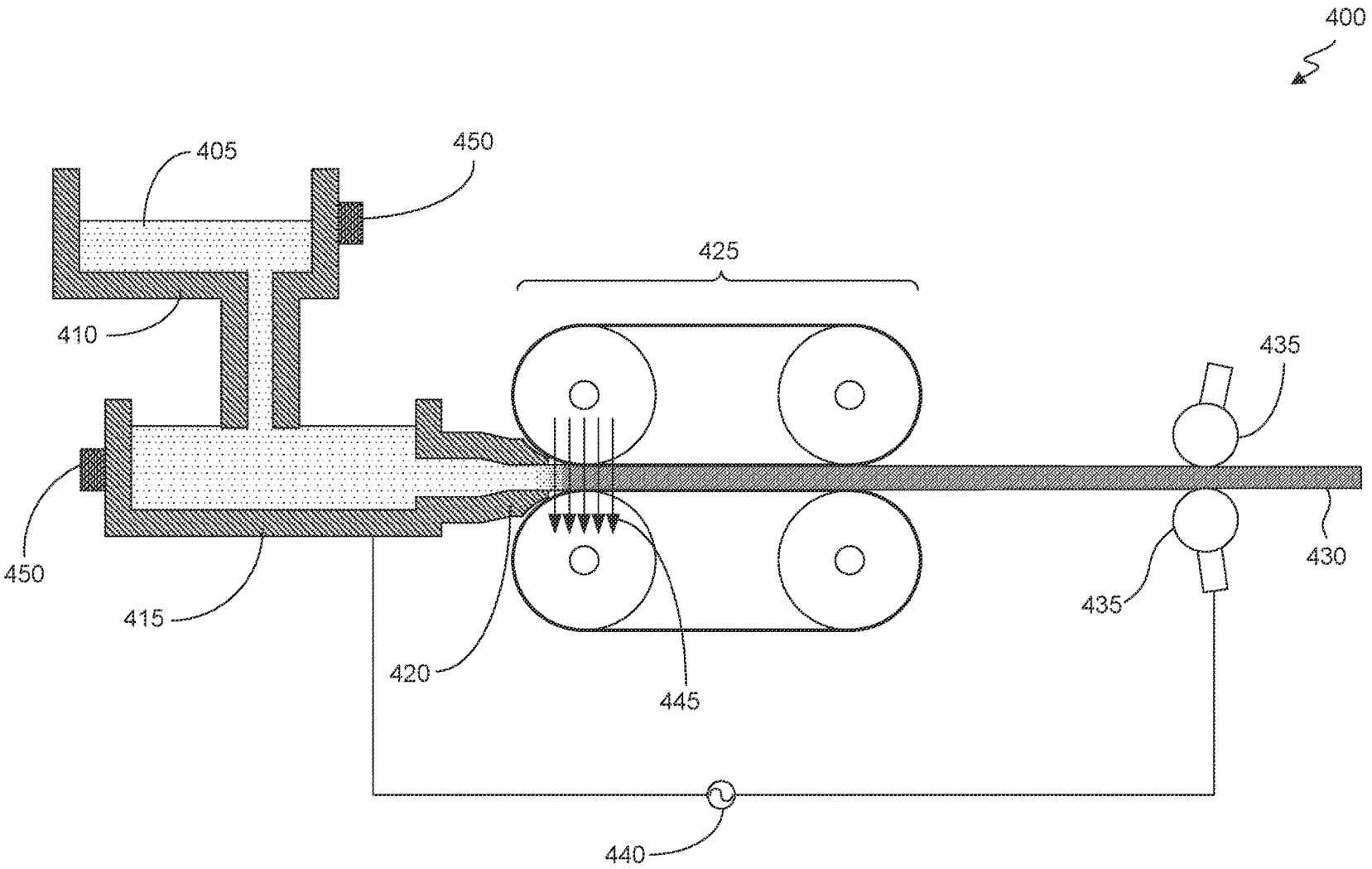
FIG. 4 is a schematic illustration of an example continuous casting process in which ultrasonic frequency magnetohydrodynamic forces are applied to a cast metal slab.

FIG. 4 shows a schematic illustration of another example continuous casting system 400. Here molten metal 405 is transferred from a launder 410 to a tundish 415 and into a nosetip or nozzle 420 of a twin-belt caster 425, where the molten metal 405 solidifies and cools to form a cast slab 430. Downstream from twin-belt caster 425, pinch rolls 435 apply pressure to cast slab 430 and draws cast slab 430 away from twin-belt caster 425. Although FIG. 4 is described as producing a cast slab 430, other cast metal products can be prepared according to the disclosed techniques, such as cast metal rods, cast metal billets, cast metal sheets, cast metal plates, or the like. Continuous casting system 400 illustrated in FIG. 4 shows a twin-belt caster 425, but such a configuration is not limiting and oilier continuous casting systems, such as twin roll casters and block casters, may be used. Further, other configurations may be used that do not employ a tundish or launder. A vertical casting orientation may also be used.

Instead of applying acoustic or mechanical ultrasonic energy within the solidification region so as to control the grain refinement that occurs, the configuration depicted in FIG. 4 is arranged to apply ultrasonic energy via magnetohydrodynamic forces. Magnetohydrodynamic forces can be generated by simultaneous application of a static magnetic field and an alternating electric field to a molten or solidifying metal. More details regarding magnetohydrodynamic forces are described by Vivès, Journal of Crystal Grown 173, 541-549, 1997, which is hereby incorporated by reference.

Pinch rolls 435 are depicted in FIG. 4 as electrically coupled to AC (alternating current) voltage source 440. Childish 415 is also illustrated is electrically coupled to AC voltage source 440. In this configuration, the AC voltage source is used to apply AC current and/or voltage to molten metal 405 as it is cast and solidifies as cast slab 430 to generate an alternating electric field within the solidification region. An example AC frequency of the AC voltage source may be from at an ultrasonic frequency, such as from 10 kHz to 100 kHz. Other configurations of the application of AC voltage or current may be used, such as where twin-belt caster 425 or nozzle 420 are electrically coupled to AC voltage source 440.

A static magnetic field 445 is applied at twin-belt caster 425. Although a downward direction of static magnetic field 445 is shown in FIG. 4, other directions may be used, such as upward, or inward or outward of the view shown in FIG. 4. Magnetic field 445 may be generated using a permanent magnetic field source or an electromagnet, for example. As magnetohydrodynamic forces are generated, these forces may be generated directly within the solidification region, or may be coupled to the solidification region by action of the cast slab 430.

One or more high-frequency sensors 450 may be positioned upstream from nosetip or nozzle 420. High-frequency sensors 450 may be used to detect residual vibrational energy that transmits through molten metal 405 to launder 410 or tundish 415, for example. The information detected by high-frequency sensors 450 may be used for feedback control to AC voltage source 440. Further feedback may be provided by examination of the grain structure of the cast slab 430, which can indicate whether the magnetohydrodynamic ultrasonic energy is affecting the grain structure of the cast slab 430.

Although the above description with respect to FIG. 4 described of use of a static magnetic field 445 and a AC voltage source 440, aspects described herein may be implemented by instead using a variable magnetic field (e.g., an electromagnet driven by a variable current source) and a DC voltage source to generate magnetohydrodynamic forces by the interaction of a variable magnetic field and a static electric field within the solidification region.

Any suitable continuous casting method may be used with the presently disclosed techniques. The continuous casting system can include a pair of moving opposed casting surfaces (e.g., moving opposed belts, rolls or blocks), a casting cavity between the pair of moving opposed casting surfaces, and a molten metal injector, also referred to herein as a nosetip or nozzle. The molten metal injector can have an end opening from which molten metal can exit the molten metal injector and be injected into the casting cavity.

A cast slab, cast billet, cast rod, or other cast product can be processed by any suitable means. Such processing steps include, but are not limited to, homogenization, hot rolling, cold rolling, solution heat treatment, and an optional pre-aging step. The cast products described herein can be used to make products in the form of sheets, plates, rods, billets, or other suitable products, for example.

In a homogenization step, for example, a cast product may be heated to a temperature ranging from about 400° C. to about 500° C., or any suitable temperature. For example, the cast product can be heated to a temperature of about 400° C., about 410° C., about 420° C., about 430° C., about 440° C., about 450° C., about 460° C., about 470° C., about 480° C., about 490° C., or about 500° C. The product is then allowed to soak (i.e., held at the indicated temperature) for a period of time to form a homogenized product. In some examples, the total time for the homogenization step, including the heating and soaking phases, can be up to 24 hours. For example, the product can be heated up to 500° C. and soaked, for a total time of up to 18 hours for the homogenization step. Optionally, the product can be heated to below 490° C. and soaked, for a total time of greater than 18 hours for the homogenization step. In some cases, the homogenization step comprises multiple processes. In some non-limiting examples, the homogenization step includes heating a cast product to a first temperature for a first period of time followed by heating to a second temperature for a second period of time. For example, a cast product can be heated to about 465° C. for about 3.5 hours and then heated to about 480° C. for about 6 hours.

Following a homogenization step, a hot rolling step can be performed. Prior to the start of hot rolling, the homogenized product can be allowed to cool to a temperature between 300° C. to 450° C. or other suitable temperature. For example, the homogenized product can be allowed to cool to a temperature of between 325° C. to 425° C. or from 350° C. to 400° C. The homogenized product can then be hot rolled at a suitable temperature, such as between 300° C. to 450° C., to form a hot rolled plate, a hot rolled spate or a hot rolled sheet having a gauge between 3 mm and 200 mm (e.g., 3 mm, 4 mm, 5 mm, 6 mm, 7 mm, 8 mm, 9 mm, 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, 110 mm, 120 mm, 130 mm, 1.40 mm, 150 mm, 160 mm, 170 mm, 180 mm, 190 mm, 200 mm, or anywhere in between).

Cast, homogenized, or hot-rolled products can be cold rolled using cold rolling mills into thinner products, such as a cold rolled sheet. The cold rolled product can have a gauge between about 0.5 to 10 mm, e.g., between about 0.7 to 6.5 mm. Optionally, the cold rolled product can have a gauge of 0.5 mm, 1.0 mm, 1.5 mm, 2.0 mm, 2.5 mm, 3.0 mm, 3.5 mm, 4.0 mm, 4.5 mm, 5.0 mm, 5.5 mm, 6.0 mm, 6.5 mm, 7.0 mm, 7.5 mm, 8.0 mm, 8.5 mm, 9.0 mm, 9.5 mm, or 10.0 mm. The cold rolling can be performed to result in a final gauge thickness that represents a gauge reduction, for example, of up to 85% (e.g., up to 10%, up to 20%, up to 30%, up to 40%, up to 50%, up to 60%, up to 70%, to 80%, or up to 85% reduction) as compared to a gauge prior to the start of cold rolling. Optionally, an interannealing step can be performed during the cold rolling step, such as where a first cold rolling process is applied, followed by an annealing process (interannealing), followed by a second cold rolling process. The interannealing step can be performed at a suitable temperature, such as from about 300° C. to about 450° C. (e.g., about 310° C., about 320° C., about 330° C., about 340° C., about 350° C., about 360° C., about 370° C., about 380° C., about 390° C., about 400° C., about 410° C., about 420° C., about 430° C., about 440° C., or about 450° C.). In some cases, the interannealing step comprises multiple processes. In some non-limiting examples, the interannealing step includes heating the partially cold rolled product to a first temperature for a first period of time followed by heating to a second temperature for a second period of time. For example, the partially cold rolled product can be heated to about 410° C. for about 1 hour and then heated to about 330° C. for about 2 hours.

Subsequently, in some cases, a cast, homogenized, or rolled product can undergo a solution heat treatment step and/or a pre-aging step.

Methods of Using the Disclosed Metal Products

The metal products described herein can be used in automotive applications and other transportation applications, including aircraft and railway applications. For example, the disclosed metal products can be used to prepare automotive structural parts, such as bumpers, side beams, roof beams, cross beams, pillar reinforcements (e.g., A-pillars, B-pillars, and C-pillars), inner panels, outer panels, side panels, inner hoods, outer hoods, or trunk lid panels. The metal products and methods described herein can also be used in aircraft or railway vehicle applications, to prepare, for example, external and internal panels.

The metal products and methods described herein can also be used in electronics applications, or any other desired application. For example, the metal products and methods described herein can be used to prepare housings for electronic devices, including mobile phones and tablet computers. In some examples, the metal products can be used to prepare housings for the outer casing of mobile phones smart phones), tablet bottom chassis, and other portable electronics.

Metals and Metal Alloys

Described herein are methods of preparing metal and metal alloy products, including those comprising aluminum, aluminum alloys, magnesium, magnesium alloys, magnesium composites, and steel, among others. In some examples, the metals for use in the methods described herein include aluminum alloys, for example, 1xxx series aluminum alloys, 2xxx series aluminum alloys, 3xxx series aluminum alloys, 4xxx series aluminum alloys, 5xxx series aluminum alloys, 6xxx series aluminum alloys, 7xxx series aluminum alloys, or 8xxx series aluminum alloys. In some examples, the materials for use in the methods described herein include non-ferrous materials, including aluminum, aluminum alloys, magnesium, magnesium-based materials, magnesium alloys, magnesium composites, titanium, titanium-based materials, titanium alloys, copper, copper-based materials, composites, sheets used in composites, or any other suitable metal, non-metal or combination of materials. In some examples, aluminum alloys containing iron are useful with the methods described herein.

By way of non-limiting example, exemplary 1xxx series aluminum alloys for use in the methods described herein can include AA1100, AA1100A, AA1200, AA1200A, AA1300, AA1110, AA1120, AA1230, AA1230A, AA1235, AA1435, AA1145, AA1345, AA1445, AA1150, AA1350, AA1350A, AA1450, AA1370, AA1275, AA1185, AA1285, AA1385, AA1188, AA1190, AA1290, AA1193, AA1198, or AA1199.

Non-limiting exemplary 2xxx series aluminum alloys for use in the methods described herein can include AA2001, A2002, AA2004, AA2005, AA2006, AA2007, AA2007A, AA2007B, AA2008, AA2009, AA2010, AA2011, AA2011A, AA2111, AA2111A, AA2111B, AA2012, AA2013, AA2014, AA2014A, AA2214, AA2015, AA2016, AA2017, AA2017A, AA2117, AA2018, AA2218, AA2618, AA2618A, AA2219, AA2319, AA2419, AA2519, AA2021, AA2022, AA2023, AA2024, AA2024A, AA2124, AA2224, AA2224A, AA2324, AA2424, AA2524, AA2624, AA2724A, A2824, AA2025, AA2026, AA2027, AA2028, AA2028A, AA2028B, AA2028C, AA2029, AA2030, AA2031, AA2032, AA2034, AA2036, AA2037, AA2038, AA2039, AA2139, AA2040, AA2041, AA2044, AA2045, AA2050, AA2055, AA2056, AA2060, AA2065, AA2070, AA2076, AA2090, AA2091, AA2094, AA2095, AA2195, AA2295, AA2196, AA2296, AA2097, AA2197, AA2297, AA2397, AA2098, AA2198, AA2099, or AA2199.

Non-limiting exemplary 3xxx series aluminum alloys for use in the methods described herein can include AA3002, AA3102, AA3003, AA3103, AA3103A, AA3103B, AA3203, AA3403, AA3004, AA3004A, AA3104, AA3204, AA3304, AA3005, AA3005A, AA3105, AA3105A, AA3105B, AA3007, AA3107, AA3207, AA3207A, AA3307, AA3009, AA3010, AA3110, AA3011, AA3012, AA3012, AA3013, AA3014AA3015, AA3016, AA3017, AA3019, AA3020, AA3021, AA3025, AA3026, AA3030, AA3130, or AA3065.

Non-limiting exemplary 4xxx series aluminum alloys for use in the methods described herein can include AA4004, A4104, AA4006, AA4007, AA4008, AA4009, AA4010, AA4013, AA4014, AA4015, AA4015A, AA4115, AA4016, AA4017, AA4018, AA4019, AA4020, AA4021, AA4026, AA4032, AA4043, AA4043A, AA4143, AA4343, AA4643, AA4943, AA4044, AA4045, AA4145, AA4145A, AA4046, AA4047, AA4047A, or AA4147.

Non-limiting exemplary 5xxx series aluminum alloys for use in the methods described herein can include AA5182, AA5183, AA5005, AA5005A, AA5205, AA5305, AA5505, AA5605, AA5006, AA5106, AA5010, AA5110, AA5110A, AA5210, AA5310, AA5016, AA5017, AA5018, AA5018A, AA5019, AA5019A, AA5119, AA5119A, AA5021, AA5022, AA5023, AA5024, AA5026, AA5027, AA5028, AA5040, AA5140, AA5041, AA5042, AA5043, AA5049, AA5149, AA5249, AA5349, AA5449, AA5449A, AA5050, AA5050A, AA5050C, AA5150, AA5051, AA5051, AA5151, AA5251, AA5251A, AA5351, AA5451, AA5052, AA5252, AA5352, AA5154, AA5154A, AA5154B, AA5154C, AA5254, AA5354, AA5454, AA5554, AA5654, AA5654A, AA5754, AA5854, AA5954, AA5056, AA5356, AA5356A, AA5456, AA5456A, AA5456B, AA5556, AA5556A, AA5556B, A5556C, AA5257, A5457, AA5557, AA5657, AA5058, AA5059, AA5070, AA5180, AA5180A, AA5082, AA5182, AA5083, AA5183, AA5183A, AA5283, AA5283A, AA5283B, AA5383, AA5483, AA5086, AA5186, AA5087, AA5187, or AA5088.

Non-limiting exemplary 6xxx series aluminum alloys for use in the methods described herein can include AA6101, AA6101A, AA6101B, AA6201, AA6201A, AA6401, AA6501, AA6002, AA6003, AA6103, AA6005, AA6005A, AA6005B, AA6005C, AA6105, AA6205, AA6305, AA6006, AA6106, AA6206, AA6306, AA6008, AA6009, AA6010, AA6110, AA6110A, AA6011, AA6111, AA6012, AA6012A, AA6013, AA6113, AA6014, AA6015, AA6016, AA6016A, AA6116, AA6018, AA6019, AA6020, AA6021, AA6022, AA6023, AA6024, AA6025, AA6026, AA6027, A6028, AA6031, A6032, AA6033, AA6040, AA6041, AA6042, AA6043, AA6151, AA6351, AA6351A, AA6451, AA6951, AA6053, AA6055, AA6056, AA6156, AA6060, AA6160, AA6260, AA6360, AA6460, AA6460BA, A6560, AA6660, AA6061, AA6061A AA6261, AA6361, AA6162, A6262, AA6262A, AA6063, AA6063A, AA6463, AA6463A, AA6763, A6963, AA6064, AA6064A, AA6065, AA6066, AA6068, AA6069, AA6070, AA6081, AA6181, AA6181A, AA6082, AA6082A, AA6182, AA6091, or AA6092.

Non-limiting exemplary 7xxx series aluminum alloys for use in the methods described herein can include AA7011, AA7019, AA7020, AA7021, AA7039, AA7072, AA7075, AA7085, AA7108, AA7108A, AA7015, AA7017, AA7018, AA7019A, AA7024, AA7025, AA7028, AA7030, AA7031, AA7033, AA7035, AA7035A, AA7046AA7046A, AA7003, AA7004, AA7005, AA7009, AA7010, AA7011, AA7012, AA7014, AA7016, AA7116, AA7122, AA7023, AA7026, AA7029, AA7129, AA7229, AA7032, AA7033, AA7034, AA7036, AA7136, AA7037, AA7040, AA7140, AA7049, AA7049, AA7049A, AA7149,7204, AA7249, AA7349, AA7449, AA7050, AA7050A, AA7150, AA7250, AA7055, AA7155, AA7255, AA7056, AA7060, AA7064, AA7065, AA7068, AA7168, AA7175, AA7475, AA7076, AA7178, AA7278, AA7278A, AA7081, AA7181, AA7185, AA7090, AA7093, AA7095, or AA7099.

Non-limiting exemplary 8xxx series aluminum alloys for use in the methods described herein can include AA8005, AA8006, AA8007, AA8008, AA8010, AA8011, AA8011A, AA8111, AA8211, AA8112, AA8014, AA8015, AA8016, AA8017, AA8018, AA8019, AA8021, AA8021, AA8021B, AA8022, AA8023, AA8024, AA8025, AA8026, AA8030, AA8130, AA8040, AA8050, AA8150, AA8076, AA8076A, AA8176, AA8077, AA8177, AA8079, AA8090, AA8091, or AA8093.

ILLUSTRATIVE ASPECTS

As used below, any reference to a series of aspects is to be understood as a reference to each of those aspects disjunctively (e.g., "Aspects 1-4" is to be understood as "Aspects 1, 2, 3, or 4").

Aspect 1 is a method of making a metal product, comprising: continuously casting a molten metal in a continuous caster to form a cast product; applying ultrasonic frequency energy to the cast product at a position downstream from the continuous caster, wherein the ultrasonic frequency energy propagates through the cast product to a solidification region of the cast product within the continuous caster.

Aspect 2 is the method of any previous or subsequent aspect, wherein the ultrasonic frequency energy corresponds to ultrasonic longitudinal waves generated by a sonotrode or ultrasonic transducer coupled to pinch rolls located at the position downstream from the continuous caster.

Aspect 3 is the method of any previous or subsequent aspect, wherein the ultrasonic frequency energy corresponds to ultrasonic transverse waves generated by a mechanical or electromechanical actuator and applied by pinch rolls located at the position downstream from the continuous caster.

Aspect 4 is the method of any previous or subsequent aspect, wherein the ultrasonic frequency energy corresponds to ultrasonic frequency magnetohydrodynamic forces generated using a static magnetic field and an ultrasonic frequency electric field.

Aspect 5 is the method of any previous or subsequent aspect, wherein the ultrasonic frequency electric field is generated using an alternating current voltage source.

Aspect 6 is the method of any previous or subsequent aspect, wherein the static magnetic field is generated using a permanent magnet or an electromagnet.

Aspect 7 is the method of any previous or subsequent aspect, wherein the ultrasonic frequency energy corresponds to ultrasonic frequency magnetohydrodynamic forces generated using an ultrasonic frequency magnetic field and a static electric field.

Aspect 8 is the method of any previous or subsequent aspect, wherein the ultrasonic frequency magnetic field is generated using an electromagnet driven by an alternating current source.

Aspect 9 is the method of any previous or subsequent aspect, wherein the static electric field is generated using a direct current voltage source.

Aspect 10 is the method of any previous or subsequent aspect, wherein the ultrasonic frequency energy has a frequency from about 10 kHz to about 100 kHz.

Aspect 11 is the method of any previous or subsequent aspect, further comprising: detecting ultrasonic frequency energy using an acoustic sensor or receiver positioned at a location upstream of the solidification region.

Aspect 12 is the method of any previous or subsequent aspect, further comprising: controlling one or more of an amplitude, frequency, or phase of the ultrasonic frequency energy using a signal derived from the ultrasonic frequency energy detected using the acoustic sensor or receiver.

Aspect 13 is the method of any previous or subsequent aspect, further comprising: modifying a position a frequency or phase of the ultrasonic frequency energy using a signal derived from the ultrasonic frequency energy detected using the acoustic sensor or receiver.

Aspect 14 is the method of any previous or subsequent aspect, wherein the acoustic sensor or receiver is coupled to a launder or tundish providing the molten metal to the continuous caster.

Aspect 15 is the method of any previous or subsequent aspect, wherein the ultrasonic frequency energy physically interacts with the growing metal grains in the solidification region.

Aspect 16 is the method of any previous or subsequent aspect, wherein the ultrasonic frequency energy fragments dendrites or disperses or deagglomerates nucleation sites in the solidification region.

Aspect 17 is the method of any previous aspect, wherein the metal product comprises an aluminum alloy.

Aspect 18 is a metal product made by or using the method of any previous aspect.

All patents, publications and abstracts cited above are incorporated herein by reference in their entirety. The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A method of making an aluminum alloy product, the method comprising:

continuously casting a molten aluminum alloy in a continuous caster to form a cast aluminum alloy product;

applying ultrasonic frequency energy to the cast aluminum alloy product at a position downstream from the continuous caster, wherein applying ultrasonic frequency energy comprises subjecting the cast aluminum alloy product to ultrasonic frequency magnetohydrodynamic forces, wherein the ultrasonic frequency energy propagates through the cast aluminum alloy product to a solidification region of the cast aluminum alloy product within the continuous caster;

detecting ultrasonic frequency energy using an acoustic sensor or receiver positioned at a location upstream of the solidification region, wherein the acoustic sensor or receiver is coupled to a launder or tundish providing the molten aluminum alloy to the continuous caster; and controlling one or more of an amplitude, frequency, or phase of the ultrasonic frequency energy using a signal derived from the ultrasonic frequency energy detected using the acoustic sensor or receiver.

2. The method of claim 1, wherein applying the ultrasonic frequency energy further comprises generating ultrasonic longitudinal waves using a sonotrode or ultrasonic transducer coupled to pinch rolls located at the position downstream from the continuous caster.

3. The method of claim 1, wherein applying the ultrasonic frequency energy further comprises generating ultrasonic transverse waves using a mechanical or electromechanical actuator and applied by pinch rolls located at the position downstream from the continuous caster.

4. The method of claim 1, wherein ultrasonic frequency magnetohydrodynamic forces are generated using a static magnetic field and an ultrasonic frequency electric field.

5. The method of claim 4, wherein the ultrasonic frequency electric field is generated using an alternating current voltage source.

6. The method of claim 4, wherein the static magnetic field is generated using a permanent magnet or an electromagnet.

7. The method of claim 1, wherein ultrasonic frequency magnetohydrodynamic forces are generated using an ultrasonic frequency magnetic field and a static electric field.

8. The method of claim 7, wherein the ultrasonic frequency magnetic field is generated using an electromagnet driven by an alternating current source.

9. The method of claim 7, wherein the static electric field is generated using a direct current voltage source.

10. The method of claim 1, wherein the ultrasonic frequency energy has a frequency from about 10 kHz to about 100 kHz.

11. The method of claim 1, further comprising:

modifying a position of application or generation of the ultrasonic frequency energy using a signal derived from the ultrasonic frequency energy detected using the acoustic sensor or receiver.

12. The method of claim 1, wherein the ultrasonic frequency energy physically interacts with growing metal grains in the solidification region.

13. The method of claim 1, wherein the ultrasonic frequency energy fragments dendrites, or disperses or deagglomerates nucleation sites in the solidification region.

14. The method of claim 1, wherein the molten aluminum alloy comprises a 1xxx series aluminum alloy, a 3xxx series aluminum alloy, a 4xxx series aluminum alloy, or a 5xxx series aluminum alloy.

15. The method of claim 1, wherein the molten aluminum alloy comprises a 2xxx series aluminum alloy, a 6xxx series aluminum alloy, or a 7xxx series aluminum alloy.

16. The method of claim 1, wherein the molten aluminum alloy comprises an 8xxx series aluminum alloy.

17. The method of claim 1, wherein the molten aluminum alloy comprises a magnesium-containing aluminum alloy.

18. The method of claim 1, wherein the molten aluminum alloy comprises a copper-containing aluminum alloy.

19. The method of claim 1, further comprising examining a grain structure of the cast aluminum alloy product and adjusting application of the ultrasonic frequency energy to modify the grain structure.

* * * * *